US008177221B2

(12) United States Patent
Wakakusa et al.

(10) Patent No.: US 8,177,221 B2
(45) Date of Patent: May 15, 2012

(54) SHEET SEPARATION DEVICE, SHEET FEED TRAY INCLUDING THE SHEET SEPARATION DEVICE, AND SHEET FEED APPARATUS INCLUDING THE SHEET SEPARATION DEVICE

(75) Inventors: Keisuke Wakakusa, Nagoya (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/729,212

(22) Filed: Mar. 22, 2010

(65) Prior Publication Data

US 2010/0244372 A1 Sep. 30, 2010

(30) Foreign Application Priority Data

Mar. 26, 2009 (JP) ..... 2009-075700

(51) Int. Cl.
*B65H 3/52* (2006.01)

(52) U.S. Cl. ..... 271/121; 271/167

(58) Field of Classification Search ..... 271/121, 271/167

See application file for complete search history.

(56) References Cited

U.S. PATENT DOCUMENTS

| | | | | |
|---|---|---|---|---|
| 6,139,007 | A | 10/2000 | Cahill et al. | |
| 6,279,897 | B1 | 8/2001 | Richards | |
| 7,370,859 | B2 * | 5/2008 | Asada | 271/121 |
| 7,946,573 | B2 * | 5/2011 | Asada et al. | 271/121 |
| 2002/0163117 | A1 | 11/2002 | Hsieh | |
| 2004/0026845 | A1 | 2/2004 | Park | |
| 2004/0084831 | A1 | 5/2004 | Asada | |
| 2005/0194734 | A1 | 9/2005 | Asada et al. | |
| 2006/0164501 | A1 | 7/2006 | Koga | |
| 2006/0180992 | A1 | 8/2006 | Asada | |
| 2007/0253037 | A1 | 11/2007 | Mo et al. | |
| 2008/0230979 | A1 | 9/2008 | Asada et al. | |
| 2009/0243184 | A1 | 10/2009 | Asada et al. | |
| 2011/0074092 | A1 | 3/2011 | Asada et al. | |
| 2011/0074093 | A1 | 3/2011 | Asada et al. | |
| 2011/0074094 | A1 | 3/2011 | Asada et al. | |

FOREIGN PATENT DOCUMENTS

JP 2002-068503 A 3/2002

OTHER PUBLICATIONS

United States Patent and Trademark Office, Office Action U.S. Appl. No. 12/728,805, dated May 9, 2011.

The State Intellectual Property Office of the People's Republic of China, Notification of First Office Action for Chinese Patent Application No. 201010148862.0, issued Aug. 3, 2011.

* cited by examiner

*Primary Examiner* — Michael McCullough
*Assistant Examiner* — Luis A Gonzalez
(74) *Attorney, Agent, or Firm* — Baker Botts L.L.P.

(57) ABSTRACT

A sheet separation device includes a separation member having a plurality of first separation portions that separate fed sheets one by one, and a turning member having an inclined surface, holes formed therethrough, and a plurality of second separation portions. The inclined surface is positioned to contact the fed sheets and turn a transport direction of the sheets. The plurality of holes are arranged along a first direction that is a transport direction of the sheets. The plurality of second separation portions contact the fed sheets and separate them one by one. Each of the second separation portions is positioned between a corresponding two holes, and each of the first separation portions is positioned to protrude from a corresponding one of the holes.

12 Claims, 11 Drawing Sheets

SHEET SEPARATION DEVICE, SHEET FEED TRAY INCLUDING THE SHEET SEPARATION DEVICE, AND SHEET FEED APPARATUS INCLUDING THE SHEET SEPARATION DEVICE

CROSS REFERENCE TO RELATED APPLICATION

The present application claims priority from Japanese Patent Application No. 2009-075700, which was filed on Mar. 26, 2009, the disclosure of which is incorporated herein by reference in its entirety.

BACKGROUND OF THE INVENTION

1. Field of the Invention

The present invention relates to a sheet separation device, a sheet feed tray including the sheet separation device, and a sheet feed apparatus including the sheet separation device.

2. Description of the Related Art

Conventionally, sheet separation devices capable of separating a plurality of sheets one by one are known. Such a sheet separation device comprises an inclined plate and a separation member that protrudes from a plurality of holes positioned on the inclined plate, and leading edges of fed sheets contact a protrusion of the separation member and the sheets can be separated one by one.

SUMMARY OF THE INVENTION

In such a sheet separation device, since the sheets are not separated until the leading edges of the sheets contact a protrusion of the separation member, the leading edges of the sheets rarely fails to be separated, which may lead to feeding of multiple sheets.

A need has arisen to provide a sheet separation device, a sheet feed tray including the sheet separation device, and a sheet feed apparatus including the sheet separation device, which reduce multiple-sheet feeding and more reliably separate sheets one by one.

In an embodiment of the invention, a sheet separation device comprises a separation member comprising a plurality of first separation portions configured to separate fed sheets one by one by contacting the fed sheets, and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, and each of the plurality of the second separation portions is positioned between a corresponding two of the plurality of the holes, and each of the plurality of the first separation portions is positioned to protrude from a corresponding one of the plurality of the holes.

In another embodiment of the invention, a sheet feed tray comprises a sheet separation device. The sheet separation device comprises a separation member comprising a plurality of first separation portions configured to separate fed sheets one by one by contacting the fed sheets, and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, and each of the plurality of the second separation portions is positioned between a corresponding two of the plurality of the holes, and each of the plurality of the first separation portions is positioned to protrude from a corresponding one of the plurality of the holes. The sheet feed tray also comprises a holding section configured to stack and hold the sheets to be fed.

In yet another embodiment of the invention, a sheet feed apparatus comprises a sheet separation device. The sheet separation device comprises a separation member comprising a plurality of first separation portions configured to separate fed sheets one by one by contacting the fed sheets, and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, and each of the plurality of the second separation portions is positioned between a corresponding two of the plurality of the holes, and each of the plurality of the first separation portions is positioned to protrude from a corresponding one of the plurality of the holes. The sheet feed apparatus also comprises a feed roller configured to feed the sheet toward the sheet separation device Other objects, features, and advantages of embodiments of the present invention will be apparent to persons of ordinary skill in the art from the following description of preferred embodiments with reference to the accompanying drawings.

DESCRIPTION OF THE PREFERRED EMBODIMENTS

First Embodiment

Figure 1:
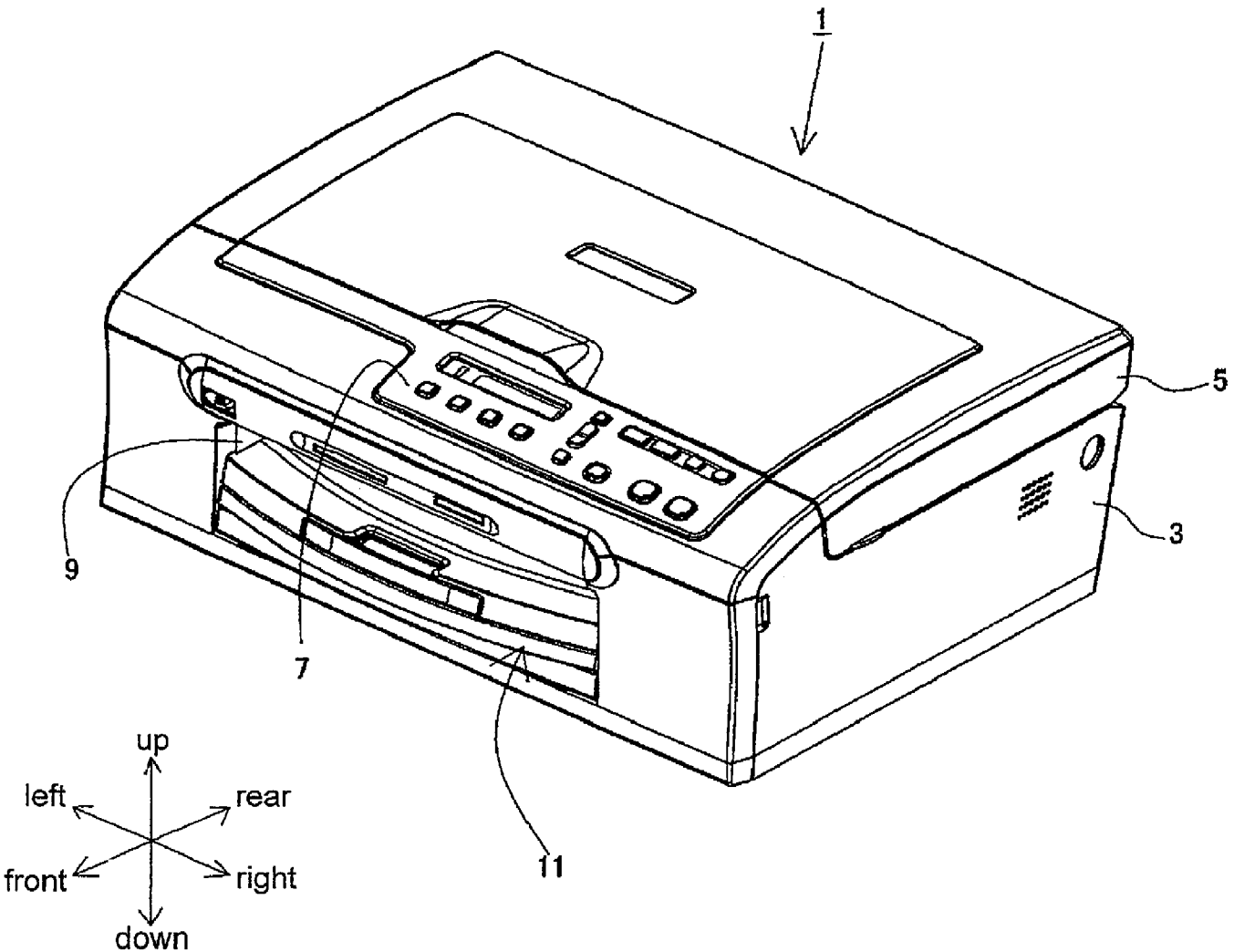
FIG. 1 is an external perspective view of an image recording apparatus according to an embodiment of the invention.

Hereinafter, a multifunctional image recording apparatus according to a first embodiment of the invention will be described with reference to the attached drawings. FIG. 1 is an external perspective view of an image recording apparatus 1 according to the first embodiment. The image recording apparatus 1 is a multifunctional inkjet printer that also functions as a scanner, a copier, a facsimile machine, etc. However, the functions except for the printer function are optional. That is, the invention may be applied to a single-function printer that does not function as a scanner, a copier, etc. In the following description, the term "front" refers to the front side of the image recording apparatus 1 in FIG. 1, and directions such as "left-right", "front-rear", and "up-down" are defined relative to the "front".

As illustrated in FIG. 1, the image recording apparatus 1 includes a casing 3 having a substantially rectangular-parallelepiped shape, a document reading section 5 disposed on the casing 3, and an operation section 7 disposed on an upper front portion of the casing 3. The casing 3 has an opening 9 formed in a front face thereof. A sheet feed tray 11 is removably inserted into the opening 9.

The document reading section 5 reads an image of a document when the image recording apparatus 1 functions as a copier or a facsimile. The document reading section 5 is rotatably supported by a rear end portion of the casing 3, so that the document reading section 5 can be opened and closed around the rear end portion. The document reading section 5 includes a glass plate (not shown) on which a document is to be placed and a document cover. The document cover can be opened and closed so as to cover the glass plate. A document reading scanner (not shown) is disposed below the glass plate. With this structure, the document reading scanner reads a document when a user opens the document cover and places the document on the glass plate.

The operation section 7, which is disposed on the upper front portion of the casing 3, includes an operation panel and a liquid-crystal display. The operation panel has various operation buttons. The liquid-crystal display displays operation guidance to a user and a state of a job in progress. The operation buttons include a start button and a stop button. A user presses the operation buttons so as to make the image recording apparatus 1 perform various functions. As necessary, various operation messages and settings of the image recording apparatus 1 are displayed on the liquid-crystal display.

[Internal Structure]

Figure 2:
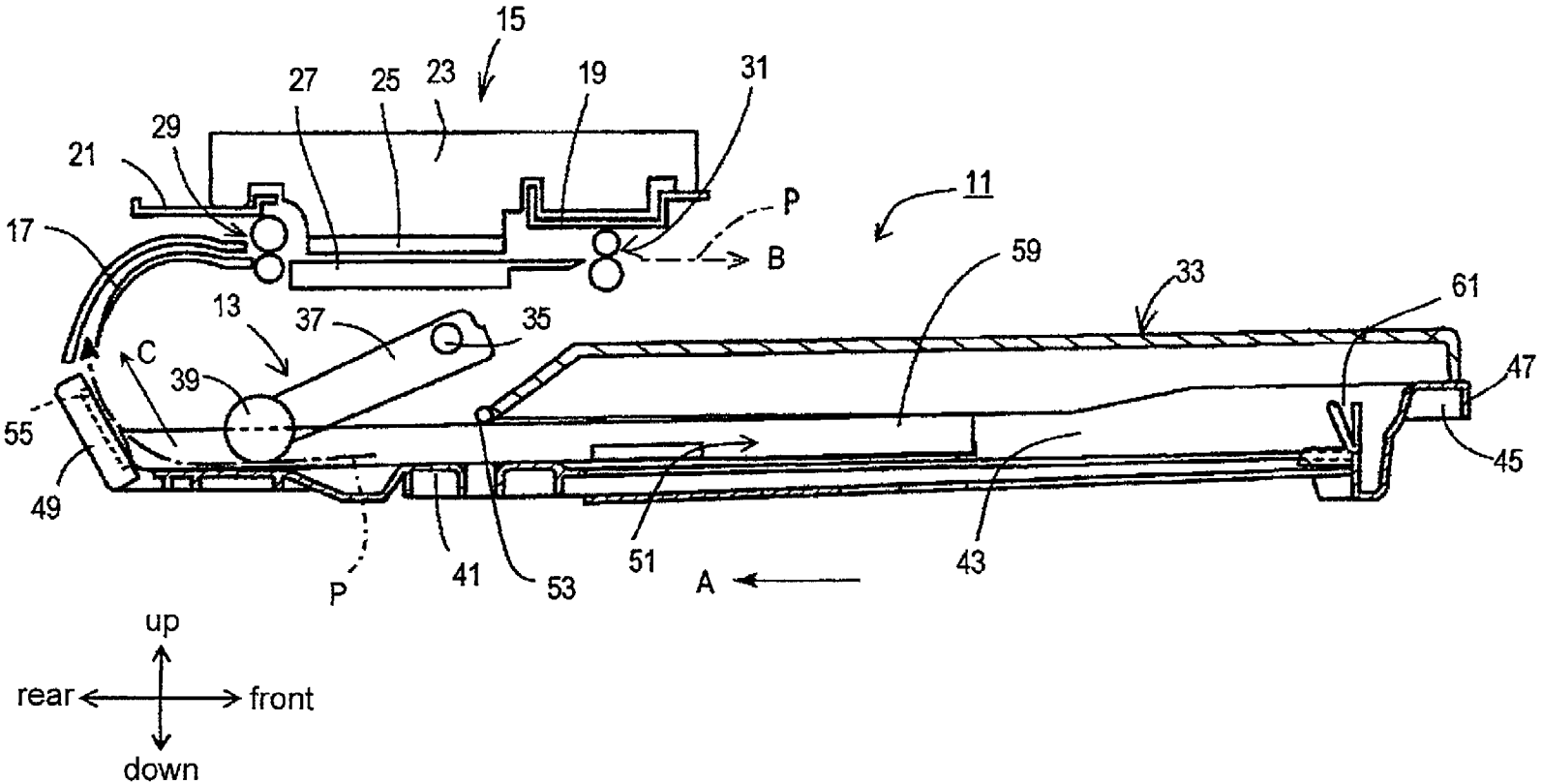
FIG. 2 is an enlarged sectional side view of a sheet feed mechanism and a recording section.

Referring to FIG. 2, the internal structure of the image recording apparatus 1 will be described in detail. FIG. 2 is a sectional side view of the sheet feed tray 11, a sheet feed mechanism 13, and a recording section 15, which are included in the image recording apparatus 1.

FIG. 2 illustrates a state in which the sheet feed tray 11 is inserted into the opening 9 in the body of the image recording apparatus 1 in FIG. 1. In this state, the recording section 15 is disposed above a sheet feed unit that is constituted by the sheet feed tray 11 and the sheet feed mechanism 13. In FIG. 2, an arrow A indicates a sheet feed direction in which a sheet P is fed. The sheet P serves as a recording medium. The sheet feed mechanism 13 feeds the sheet P, which is held in the sheet feed tray 11, in the sheet feed direction A. The sheet P is transported through a sheet transport path 17 to the recording section 15 in a transport direction indicated by an arrow B. A recording medium used in the invention is not limited to the sheet P. Various recording media on which an image can be recorded, such as an OHP transparency, can be used.

The recording section 15 includes a pair of guide members 19 and 21 that are fixed to a body frame (not shown). The guide members 19 and 21 are plate-shaped and extend in a direction perpendicular to the paper surface of FIG. 2. The guide members 19 and 21 slidably support a carriage 23. A recording head 25 is disposed facedown on a lower surface of the carriage 23. A platen 27 is disposed between the guide members 19 and 21 so as to face a lower surface of the recording head 25. A pair of resist rollers 29 are disposed upstream of the platen 27 with respect to the transport direction of the sheet P. A pair of output rollers 31 are disposed downstream of the platen 27.

The pair of resist rollers 29 feed the sheet P, which has passed through the sheet transport path 17, to a position below the recording head 25. The recording head 25 records an image on the sheet P that has been transported. The pair of output rollers 31 output the sheet P, on which the image has been recorded, to a sheet output tray 33 that is disposed on the sheet feed tray 11. The platen 27 supports the sheet P so that the distance between the sheet P and the recording head 25 is maintained to be constant while the sheet P is being transported.

The sheet feed unit constituted by the sheet feed tray 11 and the sheet feed mechanism 13 will be described in detail. As illustrated in FIG. 2, the sheet feed mechanism 13 includes a drive shaft 35, a holder portion 37, and a feed roller 39 (an example of a "feed roller" according to the present invention). The sheet feed mechanism 13 is disposed above a rear end portion of the sheet feed tray 11. The drive shaft 35 is rotatably supported by the body frame (not shown) disposed in the image recording apparatus 1. A gear (not shown) is attached to an end of the drive shaft 35. The gear is connected to a drive motor (not shown) via a known drive connection mechanism, such as a gear train, disposed in the body of the image recording apparatus 1.

The holder portion 37 can rotate around the drive shaft 35 at one end thereof. The feed roller 39 is disposed at the other end of the holder portion 37. Thus, the feed roller 39 can be lifted or lowered when the sheet feed tray 11 is inserted into or removed from the image recording apparatus 1 or when the height of the stack of the sheets P changes.

The feed roller 39 is disposed substantially at the center of the sheet feed tray 11 with respect to the left-right direction (width direction) of the sheet feed tray 11. The feed roller 39 is constituted by a pair of rollers arranged in the left-right direction. A transmission mechanism (not shown), which is constituted by a gear train, is disposed in the holder portion 37. The gear train connects the drive shaft 35 to the feed roller 39. Rotation of the drive motor is transmitted to the feed roller 39 through the drive connection mechanism, the drive shaft 35, and the transmission mechanism.

A spring (not shown) urges the holder portion 37 downward so that the feed roller 39 pressure contacts the uppermost one of the sheets P stacked in the sheet feed tray 11. The feed roller 39, to which rotation of the drive motor is transmitted, rotates clockwise in FIG. 2 while the feed roller 39 pressure contacts the uppermost sheet P, and applies a force to the sheet P in the sheet feed direction A.

Figure 3:
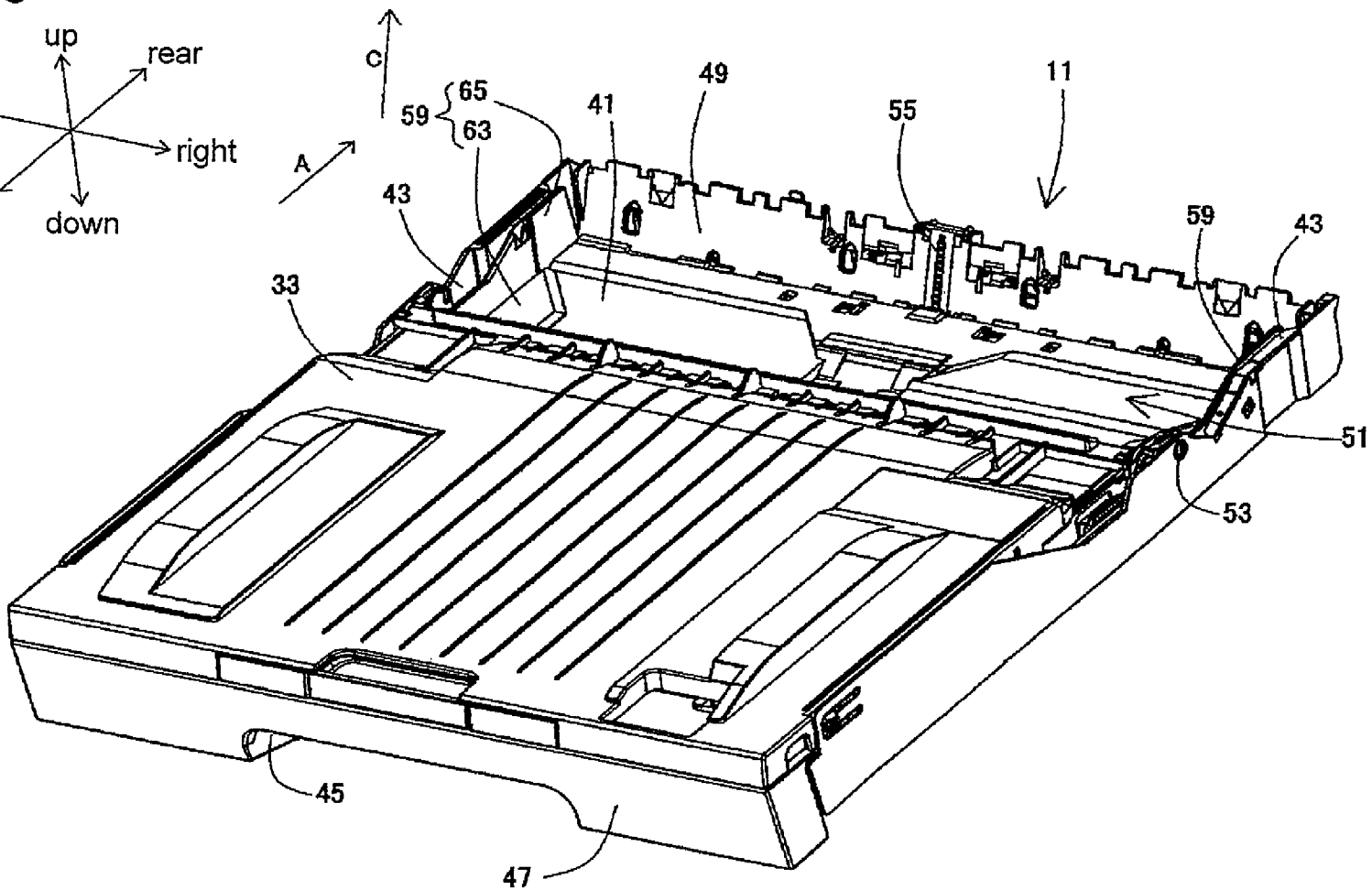
FIG. 3 is a perspective view of a sheet feed tray according to a first embodiment.
Figure 4:
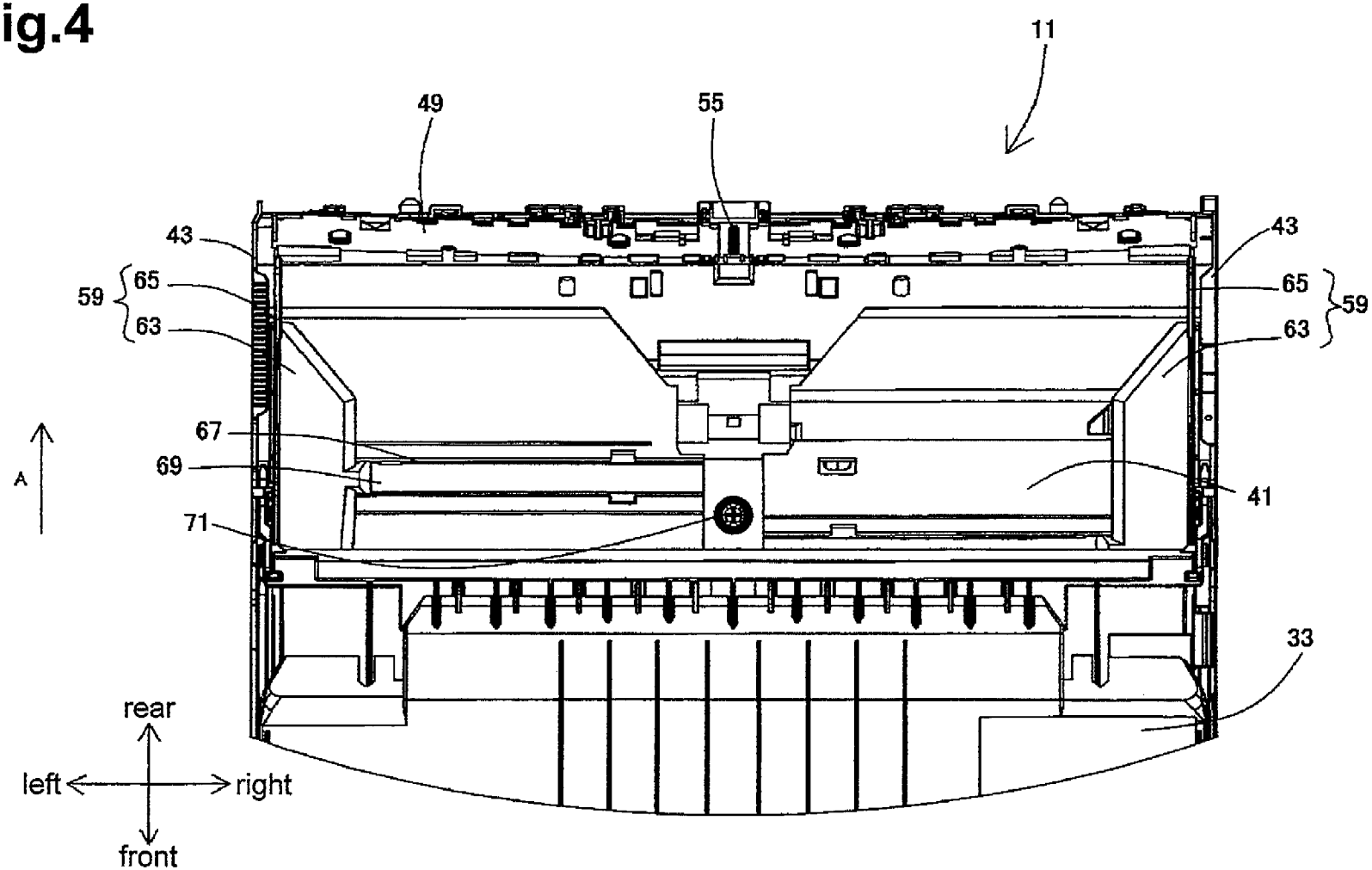
FIG. 4 is a partial plan view of the sheet feed tray according to the first embodiment.

Referring to FIGS. 2 to 4, the structure of the sheet feed tray 11 will be described in detail. FIG. 3 is a perspective view of the sheet feed tray 11. FIG. 4 is an enlarged plan view of a rear portion of the sheet feed tray 11.

The sheet feed tray 11 includes a bottom panel 41, left and right side panels 43, a front panel 47, and an inclined separation plate 49 (an example of a "transport direction turning member" and an "inclined plate" according to the present invention). The front panel 47, in which a holding groove 45 is formed, is located at the upstream end of the sheet feed tray 11 with respect to the sheet feed direction A. The inclined separation plate 49 is disposed at the downstream end of the sheet feed tray 11 with respect to the sheet feed direction A.

With this structure, the sheet feed tray 11 provides a holding section 51 (an example of a "holding section" according to the present invention) that holds a stack of the sheets P. The sheet output tray 33 is disposed over the holding section 51.

The sheet feed tray 11 is configured so that the sheet feed tray 11 can hold a large number of the sheets P, each sheet P being of a size such as, A4, letter, or legal, and being stacked so that the short sides of the sheets P are parallel to the inclined separation plate 49 in FIG. 3. The holding section 51 of the sheet feed tray 11 can hold up to 150 plain paper sheets, which is about 15 mm in terms of the height of the stack of the sheets P.

The sheet output tray 33 can be rotated around connection portions 53 disposed on the left and right side panels 43 of the sheet feed tray 11, so that a front side of the sheet output tray 33 can be opened upward relative to the upper surface of the sheet feed tray 11. In this state, the sheets P having a predetermined size can be supplied to the holding section 51 of the sheet feed tray 11 without removing the sheet output tray 33.

As illustrated in FIGS. 3 and 4, the inclined separation plate 49 is disposed at the downstream end of the sheet feed tray 11 with respect to the sheet feed direction A. A separation member 55 (an example of a "separation member" according to the present invention), which serves as separation means, is disposed along a surface of the inclined separation plate 49 at substantially the center of the inclined separation plate 49 with respect to the left-right direction. The structure of the separation member 55 will be described below.

As illustrated in FIG. 2, when feeding of the sheets P starts, the feed roller 39 applies a force to the sheets P in the sheet feed direction A. When leading edges of the sheets P contact the inclined separation plate 49 and the separation member 55, the inclined separation plate 49, the separation member 55, and the feed roller 39 cooperatively separate the sheets P one by one and feed out each of the sheets P in a feed-out direction indicated by an arrow C. The sheet P that has been separated and fed out passes through the sheet transport path 17 having a U-shape, and is transported to the recording section 15 in the transport direction indicated by the arrow B. The recording section 15 records an image on an upper surface of the sheet P that has been transported. The sheet P is output to the sheet output tray 33 with the recorded surface facing upward.

As illustrated in FIGS. 3 and 4, the sheet feed tray 11 includes a pair of side guides 59. The side guides 59 guide and position side edges of the sheets P held in the holding section 51, the side edges being parallel to the sheet feed direction A. As illustrated in FIG. 2, the sheet feed tray 11 includes a rear guide 61. The rear guide 61 contacts trailing edges of the sheets P held in the holding section 51, the trailing edges being in the upstream end of the sheets P with respect to the sheet feed direction A. The rear guide 61 can be moved in directions parallel to the sheet feed direction A.

The side guides 59 can be slidably moved on the bottom panel 41 between the left and right side panels 43 of the sheet feed tray 11 in directions perpendicular to the sheet feed direction A (left-right directions). Each side guide 59 includes a slider 63 that is parallel to the bottom panel 41, and a contact plate 65 standing upright on the slider 63. One of the side guides 59 includes a lock knob (not shown) that is used for a positioning operation.

Each slider 63 includes a rack 69 that extends toward the side guide 59 included in the other slider 63. The racks 69 extend along guide grooves 67 formed in the bottom panel 41 and extending parallel to each other. Rack teeth (not shown) are formed on a surface of the each rack 69. A pinion 71 is disposed on the center line of the bottom panel 41 with respect to the left-right direction. The pinion 71 is rotatable and meshes with the rack teeth. With this structure, when a user operates the lock knob so as to move the side guides, the rack teeth of the racks 69 mesh with the pinion 71, so that the sliders 63 slide on the upper surface of the bottom panel 41. Thus, the user can perform so-called "center positioning", with which the center line of the sheet feed tray 11 with respect to the width direction is aligned with the center line between the sliders 63, which is the center line of the sheets P held in the sheet feed tray 11 with respect to the width direction.

Figure 5:
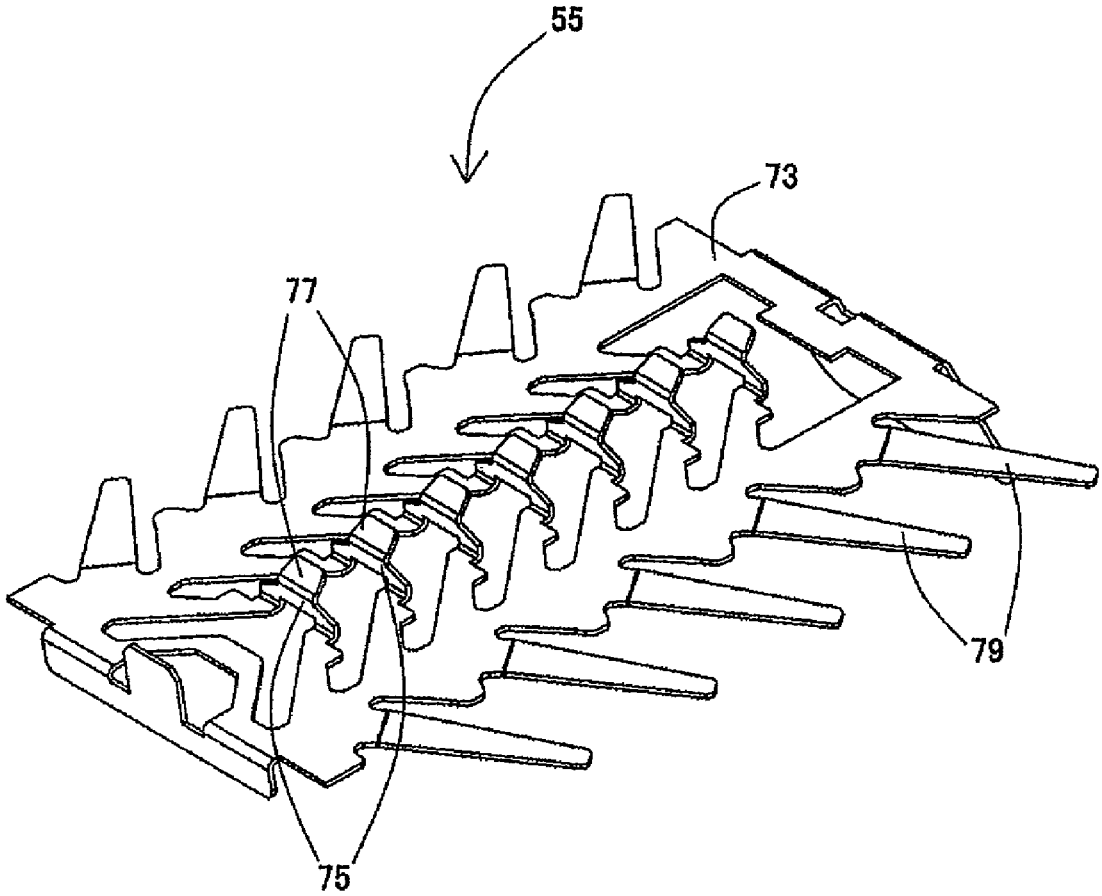
FIG. 5 is a perspective view of a separation member of the invention.
Figure 6A:
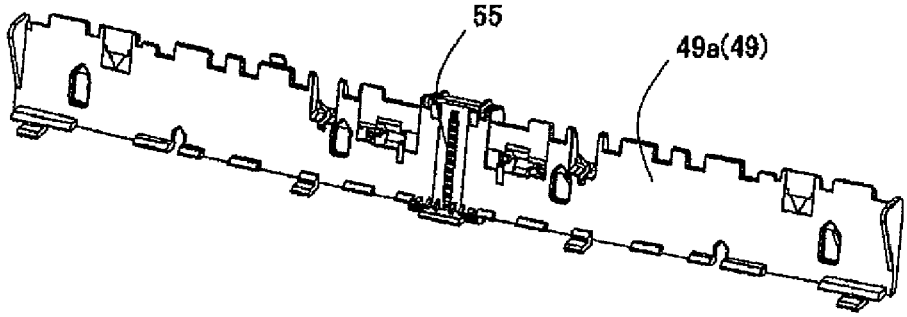
FIG. 6A is a perspective view.
Figure 6B:
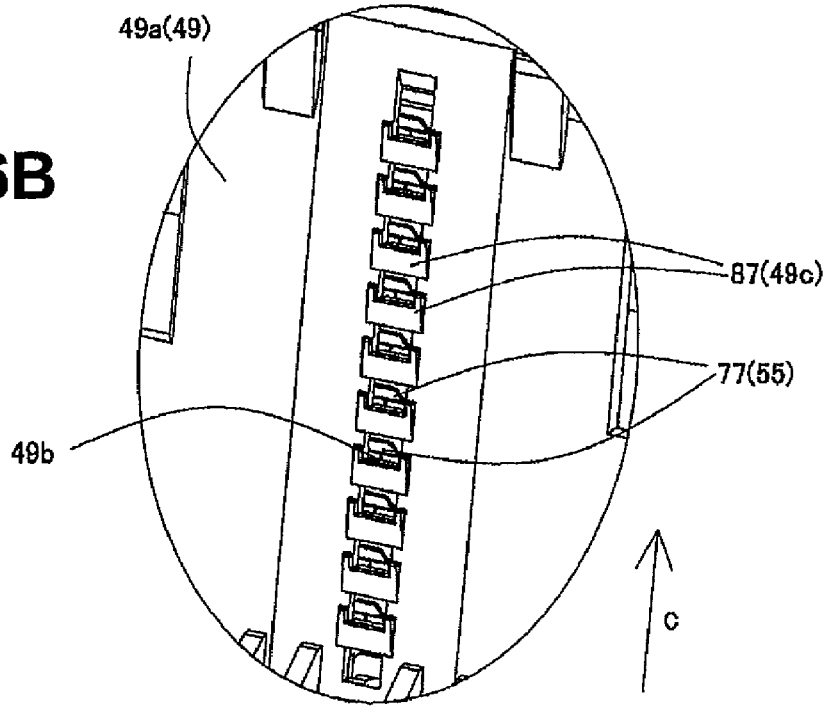
FIG. 6B is an enlarged partial perspective view of an inclined separation plate according to the first embodiment.
Figure 7A:
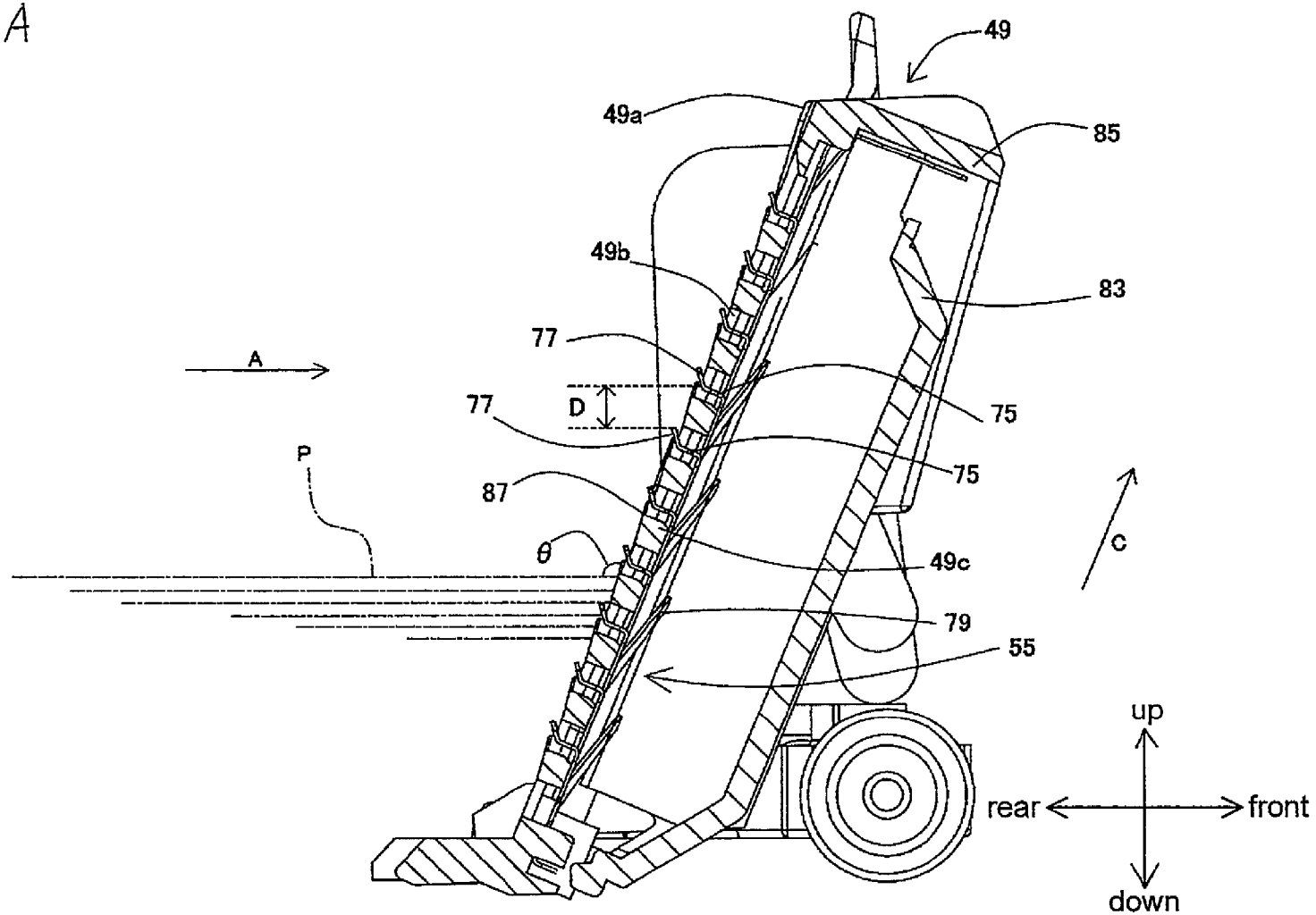
FIG. 7A is a sectional side view.
Figure 7B:
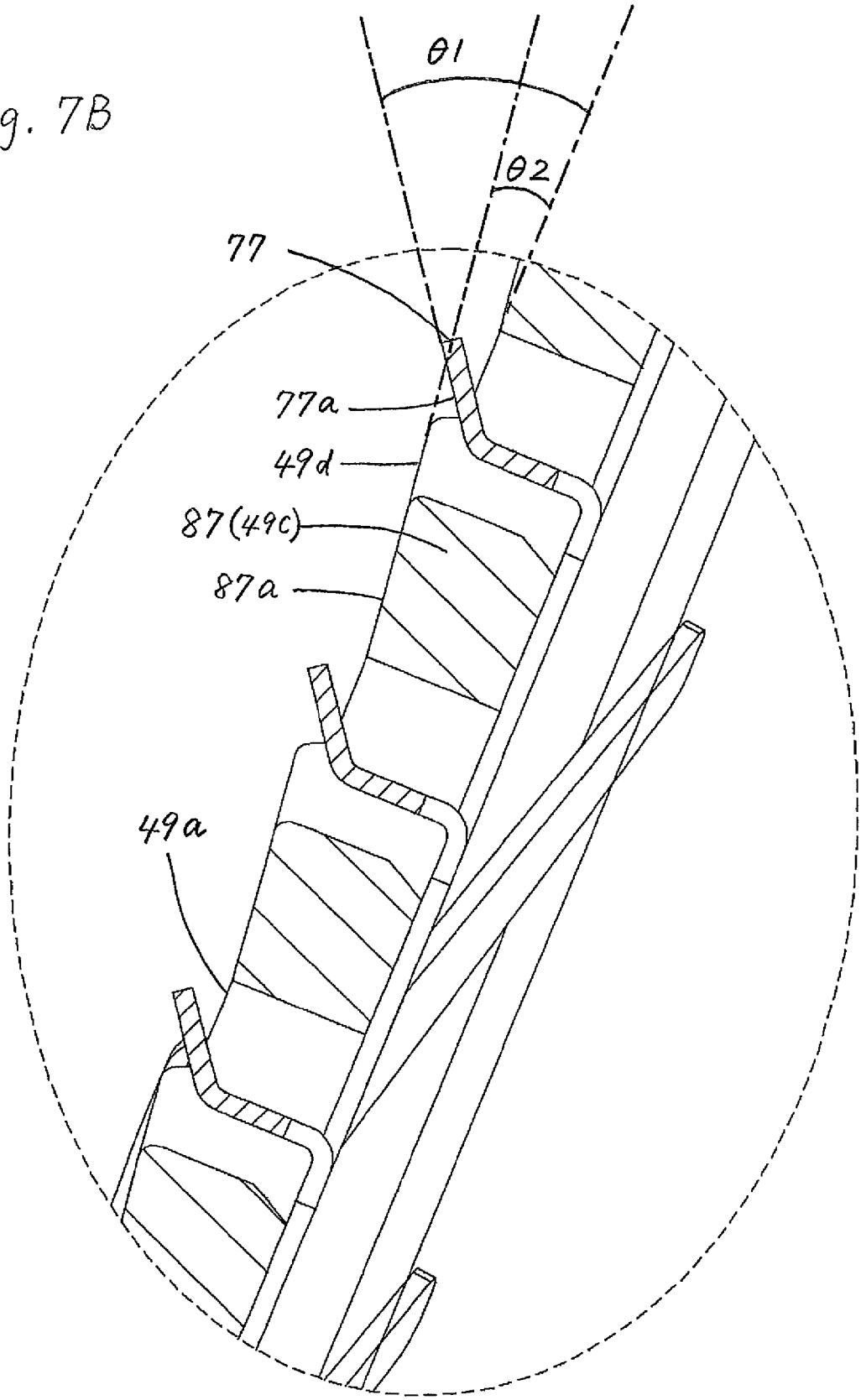
FIG. 7B is an enlarged partial sectional view of the inclined separation plate according to the first embodiment.

FIG. 5 is a perspective view of the separation member 55 disposed on the inclined separation plate 49. FIG. 6A is a perspective view, and FIG. 6B is an enlarged partial perspective view of the inclined separation plate 49 to which the separation member 55 is attached. FIG. 7A is a sectional side view, and FIG. 7B is an enlarged partial sectional side view of the inclined separation plate 49.

The separation member 55 is made from a spring plate made of elastic metal. As illustrated in FIG. 5, the separation member 55 includes a base portion 73 that is flat, arm portions 75 cut and raised from the base portion 73, and separation claws 77 (an example of a "first separation member" according to the present invention) made by bending tip ends of the arm portions 75 toward the upper right direction in FIG. 5. Leg portions 79 are formed on both sides of the base portion 73. The leg portions 79 generate an urging force when the separation member 55 is attached to the sheet feed tray 11. The leg portions 79 extend in a direction opposite the direction in which the arm portions 75 are raised. The separation member 55 is made by press punching a metal plate and subjecting the metal plate to a predetermined bending process. The separation claws 77, each extending from a bent portion of the arm portion 75 to the tip end that is a free end, contact the sheet P.

As illustrated in FIG. 6B, the separation member 55 is attached to the inclined separation plate 49 so that the separation claws 77 protrude from an inclined surface 49*a* (an example of an "inclined surface" according to the present invention) of the inclined separation plate 49. The inclined separation plate 49 is detachably disposed in the rear end portion of the sheet feed tray 11. The inclined separation plate 49 and the sheet feed tray 11 are made by injection-molding a plastic. The inclined separation plate 49 is made of a material having a low coefficient of friction such as polyoxymethylene (POM).

The inclined separation plate 49 is curved in plan view so that the inclined separation plate 49 protrudes forward at a middle portion with respect to the left-right direction (width direction of the sheet P) and gradually recedes toward end portions with respect to the left-right direction. Thus, when the feed roller 39 feeds the sheets P, the leading edges of the sheets P contact the inclined separation plate 49 at the middle portion, at which the separation member 55 is disposed, so that the other portions of the inclined separation plate 49 do not interfere with feeding of the sheet P.

As illustrated in FIG. 7A, window holes 49*b* (an example of a "hole" according to the present invention) are formed in the middle portion of the inclined separation plate 49 with respect to the left-right direction. The window holes 49*b* are linearly arranged at predetermined intervals in the feed-out direction C. The separation claws 77 of the separation member 55 extend through the window holes 49*b* from the rear side of the inclined separation plate 49 (the back side of the inclined surface 49*a*). Bridge portions 49*c* (an example of a "second separation member" according to the present invention) are disposed between the window holes 49*b*. An attachment case 85 is formed on the back side of the inclined separation plate 49 so as to surround all the window holes 49*b*. The attachment case 85 holds a support member 83 that is box-shaped and that serves as a supporting member for supporting the separation member 55.

The separation member 55 is inserted into the attachment case 85 from the rear side of the inclined separation plate 49, the separation claws 77 are inserted into the window holes 49*b*, and the support member 83 is fixed. In this state, the support member 83 supports all the leg portions 79 of the separation member 55. As a result, the base portion 73 contacts the back side of the inclined separation plate 49, and the separation claws 77 extend through the window holes 49*b* and protrude from the inclined surface 49*a* of the inclined separation plate 49 by a predetermined amount.

The separation member 55 is punched out of a metal plate, and the separation claws 77 are cut and raised from the separation member 55. Therefore, the tip end of each separation claw 77 is separated by a certain distance from an end portion of an adjacent separation claw 77 at which the adjacent separation claw 77 is bent from the arm portion 75. In other words, there are gaps in which the separation claws 77 do not exist. When the separation member 55 is attached to the inclined separation plate 49, the bridge portions 49*c* between the window holes 49*b* in the inclined separation plate 49 cover the gaps between the separation claws 77. That is, the inclined separation plate 49 exists in a region D in FIG. 7A. The region D is a region extending from the tip end of one separation claw 77 to an end portion of an adjacent separation claw 77 at which the adjacent separation claw 77 is bent from the arm portion 75, the adjacent separation claw 77 being downstream of (immediately above) the one separation claw 77 with respect to the feed-out direction indicated by the arrow C. Therefore, depending on the amount of the sheets P stacked on the sheet feed tray 11, the leading edge of the uppermost sheet P to be fed or the leading edges of the sheets P below the uppermost sheet P contact the bridge portion 49*c* of the inclined separation plate 49 before contacting the separation claw 77.

As illustrated in FIGS. 6B, 7A and 7B, frictional resistance sections 87 are disposed on the inclined surface 49*a* of the inclined separation plate 49 so as to cover the positions at which the separation claws 77 do not exist. Each frictional resistance section 87 has a U-shaped surface so as to cover about a lower half of the window hole 49*b*. To be specific, each frictional resistance section 87 extends from the upstream end of the bridge portions 49*c* between the window holes 49*b* to the downstream end of the bridge portion 49*c* with respect to the feed-out direction C, and also comprises a portion 49*d* (an example of a "third separation member" according to the present invention) which extends along the left and right sides of the window holes 49*b*. Therefore, the frictional resistance section 87 is disposed at a position corresponding to about a lower half of the left and right sides of the bridge portion 49*c* and the window hole 49*b*.

The frictional resistance sections 87 are integrally formed with the inclined separation plate 49 so that the amount of protrusion from the inclined surface 49*a* of the inclined separation plate 49 increases from the lower end to the upper end of the frictional resistance sections 87, that is, from the upstream side to the downstream side with respect to the feed-out direction C. Therefore, the angle between a surface of the frictional resistance section 87 and the sheets P that are substantially horizontally held in the sheet feed tray 11 (the angle θ in FIG. 7A, which is measured clockwise with respect to the sheet P) is smaller than the angle between the bridge portion 49*c* and the sheets P in a state in which the frictional resistance section 87 is not formed on the inclined separation plate 49. With this structure, when the leading edges of the sheets P contact the frictional resistance section 87, a larger friction resistance is applied to the leading edges of the sheets P than when the leading edges of the sheets P contact the inclined separation plate 49. Thus, as shown in FIG. 7B, an angle θ1 between the inclined surface 49*a* of the inclined separation plate 49 and a first contact surface 77*a* (an example of a "first contact surface" according to the present invention) where the separation claws 77 contacts the sheet P is larger than an angle θ2 between the inclined surface 49*a* of the inclined separation plate 49 and a second contact surface 87*a* (an example of a "second contact surface" according to the present invention) where the frictional resistance sections 87 contacts the sheet P.

The amount of protrusion from the inclined surface 49*a* to a tip end of the bridge portion 49*c* of each frictional resistance section 87 is smaller than the amount of protrusion from the inclined surface 49*a* to a tip end of each separation claw 77.

With this structure, if one or some of the sheets P at the top of the stack of the sheets P held in the sheet feed tray 11 are at a height at which the separation claw 77 does not exist and the frictional resistance section 87 of the inclined separation plate 49 exists, when the feed roller 39 rotates to start feeding the sheets P and applies a force to the sheets P in the sheet feed direction A, the leading edges of the sheets P first contact the frictional resistance section 87. Because the feed roller 39 continues rotating in a state in which the leading edges of the sheets P contact the frictional resistance section 87, the inclined separation plate 49 applies a force to the leading edges of the sheets P in a direction opposite the sheet feed direction A so as to push back the sheets P, whereby the leading edges of the sheets P become curved on the inclined separation plate 49. For the sheets P that are not at the uppermost position, a force to push back the sheets P applied by the frictional resistance section 87 is larger than a force to feed the sheets P in the sheet feed direction A. Thus, the sheets P that are not at the uppermost position are pushed back, and only the uppermost sheet P is fed in the feed-out direction C against the push-back force applied by the frictional resistance section 87.

If the sheets P that are not at the uppermost position are not separated by the frictional resistance section 87 and the leading edges of the sheets P surmount the frictional resistance section 87, the leading edges of the sheets P contact the separation claw 77 that is disposed downstream of the frictional resistance section 87 with respect to the feed-out direction C (above the frictional resistance section 87). At this time, the separation claw 77, which is elastic, leans in the sheet feed direction A. Nevertheless, the separation claw 77 applies a push-back force to the leading edges of the sheets P, so that only the uppermost sheet P, which the feed roller 39 directly contacts and applies a force, is reliably separated.

The amount of protrusion of each frictional resistance section 87 is smaller than the maximum amount of protrusion of each separation claw 77. Therefore, the leading edge of the sheet P that has contacted the frictional resistance section 87 after feeding of the sheets P started and that has surmounted the frictional resistance section 87 and contacted the separation claw 77 disposed downstream of the frictional resistance section 87 is fed out toward the recording section 15 along the inclined separation plate 49 while reliably contacting only the separation claws 77. As a result, only the uppermost sheet P, among the sheets P held in the sheet feed tray 11, is reliably fed.

Only the leading edge of the sheet P contacts the frictional resistance sections 87 and the separation claws 77, and the frictional resistance sections 87 are linearly arranged along the window holes 49*b* so as to surround the separation claws 77. Therefore, only a small area, if any, of the leading edge of the sheet P might be damaged by contacting the frictional resistance sections 87 and the separation claws 77. Moreover, skew does not occur, because the position at which the frictional resistance sections 87 and the separation claws 77 contact the leading edge of the sheet P does not deviate with respect to the width direction of the sheet P that is perpendicular to the feed-out direction. The frictional resistance section 87 extends to a position near an end portion of the separation claw 77 at which the separation claw 77 is bent from the arm portion 75, or to a position overlapping the end portion. Therefore, the frictional resistance section 87 reliably exists in a position at which the separation claw 77 does not exist so as to perform a separating operation, whereby the leading edges of the sheets P are separated and multiple-sheet feeding can be reduced.

Second Embodiment

Figure 8A:
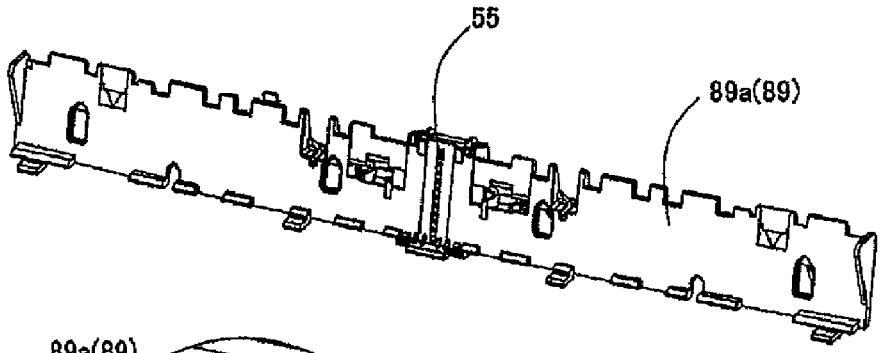
FIG. 8A is a perspective view.
Figure 8B:
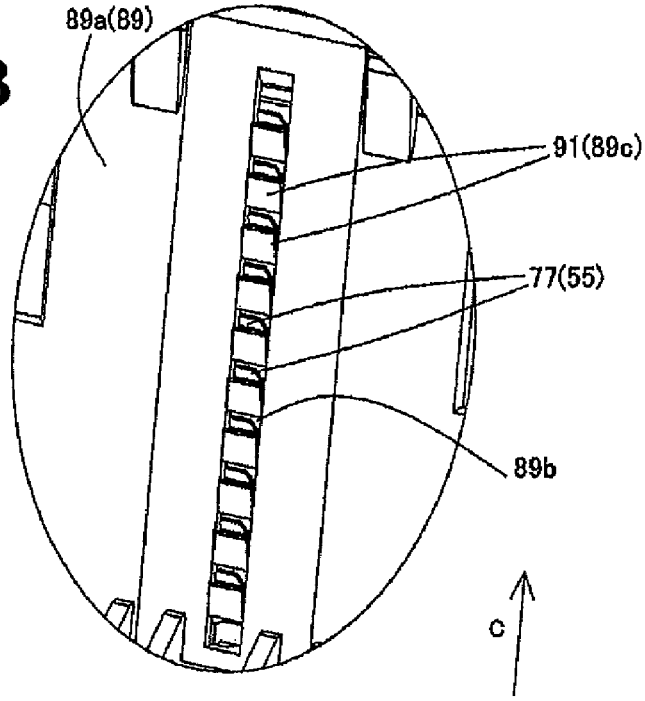
FIG. 8B is an enlarged partial perspective view of an inclined separation plate according to a second embodiment.
Figure 9A:
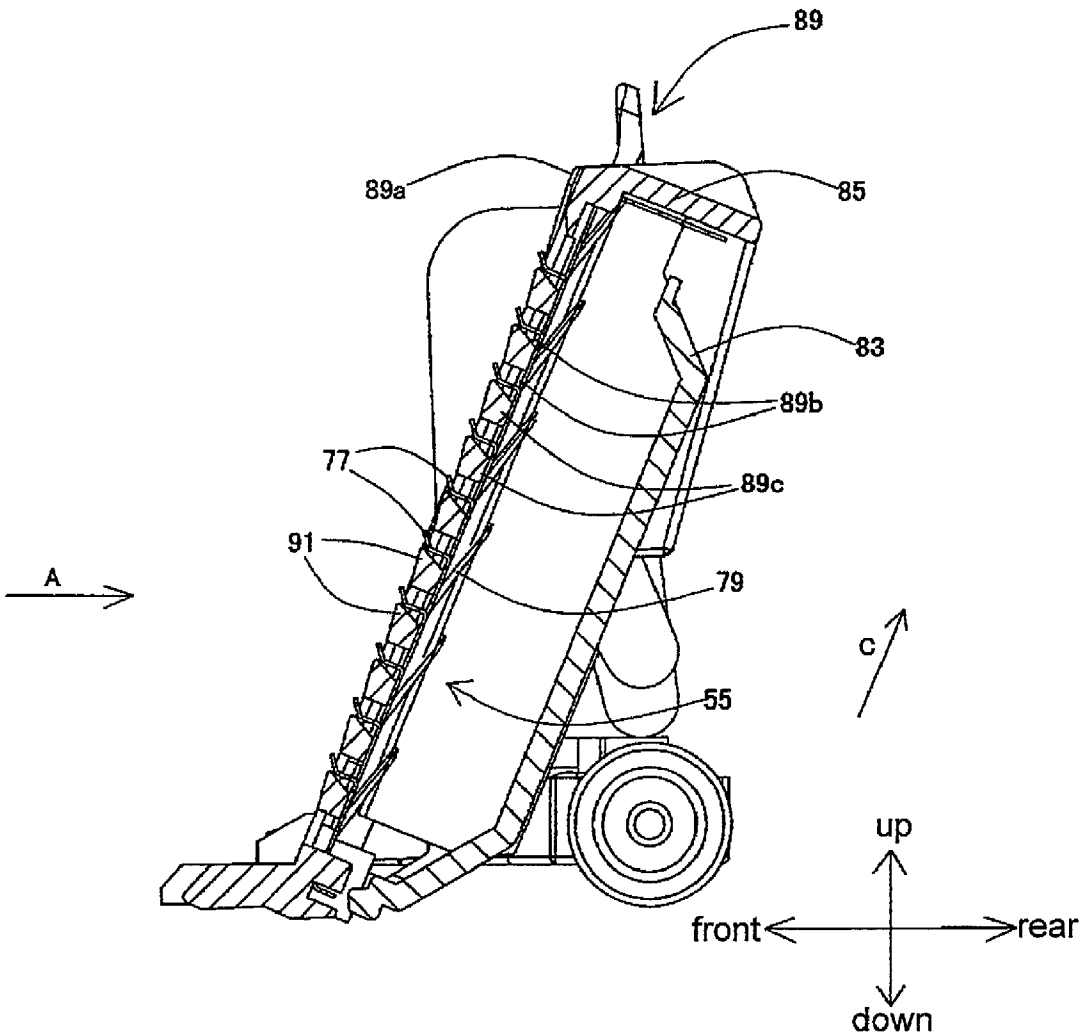
FIG. 9A is a sectional side view.
Figure 9B:
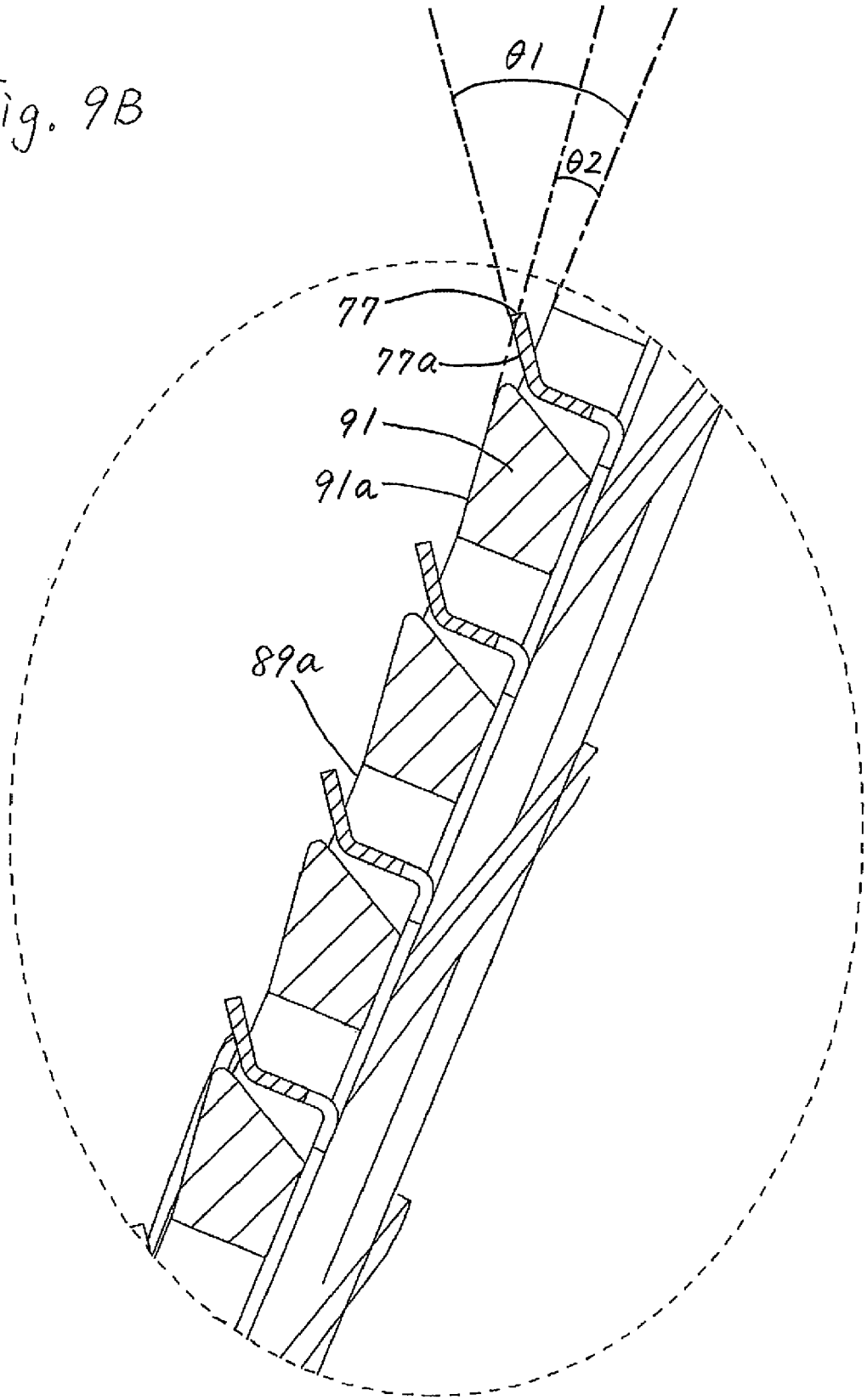
FIG. 9B is an enlarged partial sectional view of the inclined separation plate according to the second embodiment.

Referring to FIGS. 8A to 9B, a second embodiment of the invention will be described. The second embodiment is the same as the first embodiment except for the structure of the inclined separation plate 49. Therefore, only components that differ from those of the first embodiment will be described in detail, and common components will be denoted by the same numerals. FIG. 8A is a perspective view, and FIG. 8B is an enlarged partial perspective view of an inclined separation plate 89 of the sheet feed tray 11. FIG. 9A is a side view, and FIG. 9B is an enlarged partial side view of the inclined separation plate 89.

As illustrated in FIG. 8B, window holes 89*b* (an example of a "hole" according to the present invention) are formed in the middle portion of an inclined separation plate 89 (an example of a "transport direction turning member" and an "inclined plate" according to the present invention) with respect to the left-right direction. The window holes 89*b* are linearly arranged at predetermined intervals in the feed-out direction C. The arm portions 75 and the separation claws 77 of the separation member 55 extend through the window holes 89*b* from the rear side of the inclined separation plate 89 (the back side of an inclined surface 89*a*). The separation claws 77 extend through the window holes 89*b* and protrude from the inclined surface 89*a* (an example of an "inclined surface" according to the present invention) of the inclined separation plate 89 by a predetermined amount.

As illustrated in FIGS. 8B and 9, on the inclined surface 89*a* of the inclined separation plate 89, frictional resistance sections 91 are disposed on bridge portions 89*c* between the window holes 89*b* so as to cover the positions at which the separation claws 77 do not exist. Each frictional resistance section 91 is disposed so as to cover an entire surface of a corresponding bridge portion 89*c*. To be precise, each frictional resistance section 91 extends from the upstream end of the bridge portion between the window holes 89*b* to the downstream end of the bridge portion with respect to the feed-out direction C. As illustrated in FIG. 9, a lower end portion of the window hole 89*b* extends upward along the separation claw 77, which extends diagonally upward from a bent portion at which the separation claw 77 is bent from the arm portion 75 to the tip end that is a free-end. Thus, the area of the window hole 89*b* decreases toward the inclined surface 89*a* of the inclined separation plate 89. With this structure, the lower end portion of the window hole 89*b*, that is, the upper end of the frictional resistance section 91, exists immediately below the bent portion of the separation claw 77. Therefore, the frictional resistance section 91 reliably exists at a position at which the separation claw 77 does not exist.

As with the first embodiment, the frictional resistance sections 91 are integrally formed with the inclined separation plate 89 so that the amount of protrusion from the inclined surface 89*a* of the inclined separation plate 89 increases from the lower end to the upper end of the frictional resistance sections 91, that is, from the upstream side to the downstream side with respect to the feed-out direction C. Therefore, the angle between a surface of the frictional resistance section 91 and the sheets P that are substantially horizontally held in the sheet feed tray 11 is smaller than the angle between the bridge portion 89*c* and the sheets P in a state in which the frictional resistance section 91 is not formed on the inclined separation plate 89. With this structure, when the leading edges of the sheets P contact the frictional resistance section 91, a larger friction resistance is applied to the leading edges of the sheets P than when the leading edges of the sheets P contact the inclined separation plate 89. Thus, as shown in FIG. 9B, an angle θ1 between the inclined surface 89*a* of the inclined separation plate 89 and a first contact surface 77*a* (an example of a "first contact surface" according to the present invention) where the separation claws 77 contacts the sheet P is larger than an angle θ2 between the inclined surface 89*a* of the inclined separation plate 89 and a second contact surface 91*a* (an example of a "second contact surface" according to the present invention) where the frictional resistance sections 91 contacts the sheet P.

The amount of protrusion from the inclined surface 89*a* to a tip end of the bridge portion 89*c* of each frictional resistance section 91 is smaller than the amount of protrusion from the inclined surface 89*a* to a tip end of each separation claw 77.

With this structure, if one or some of the sheets P at the top of the stack of the sheets P held in the sheet feed tray 11 are at a height at which the separation claw 77 does not exist and the frictional resistance section 91 of the inclined separation plate 89 exists, when the feed roller 39 rotates to start feeding the sheets P and applies a force to the sheets P in the sheet feed direction A, the leading edges of the sheets P first contact the frictional resistance section 91. Because the feed roller 39 continues rotating in a state in which the leading edges of the sheets P contact the frictional resistance section 91, the inclined separation plate 89 applies a force to the leading edges of the sheets P in a direction opposite the sheet feed direction A so as to push back the sheets P, whereby the leading edges of the sheets P become curved on the inclined separation plate 89. For the sheets P that are below the uppermost position, a force to push back the sheets P applied by the frictional resistance section 91 is larger than a force to feed the sheets P in the sheet feed direction A. Thus, the sheets P that are not at the uppermost position are pushed back, and only the uppermost sheet P is fed in the feed-out direction C against the push-back force applied by the frictional resistance section 91.

If the sheets P that are not at the uppermost position are not separated by the frictional resistance section 91 and the leading edges of the sheets P surmount the frictional resistance section 91, the leading edges of the sheets P contact the separation claw 77 that is disposed downstream of the frictional resistance section 91 with respect to the feed-out direction C (above the frictional resistance section 91). At this time, the separation claw 77, which is elastic, leans in the sheet feed direction A. Nevertheless, the separation claw 77 applies a push-back force to the leading edges of the sheets P, so that only the uppermost sheet P, to which the feed roller 39 directly contacts and applies a force, is reliably separated.

The amount of protrusion of each frictional resistance section 91 is smaller than the maximum amount of protrusion of each separation claw 77. Therefore, the leading edge of the sheet P that has contacted the frictional resistance section 91 after feeding of the sheets P started and that has surmounted the frictional resistance section 91 and contacted the separation claw 77 disposed downstream of the frictional resistance section 91 is fed out toward the recording section 15 along the inclined separation plate 89 while contacting only the separation claws 77. As a result, only the uppermost sheet P, among the sheets P held in the sheet feed tray 11, is reliably fed.

Only the leading edge of the sheet P contacts the frictional resistance sections 91 and the separation claws 77, and the frictional resistance sections 91 are linearly arranged over the entire bridge portions 89*c* between the window holes 89*b*. Therefore, only a small area, if any, of the leading edge of the sheet P might be damaged by contacting the frictional resistance sections 91 and the separation claws 77. Moreover, skew does not occur, because the position at which the frictional resistance sections 91 and the separation claws 77 contact the leading edge of the sheet P does not deviate with respect to the width direction of the sheet P that is perpendicular to the feed-out direction. The frictional resistance section 91 extends to a position near an end portion of the separation claw 77 at which the separation claw 77 is bent from the arm portion 75, or to a position overlapping the end portion. Therefore, the frictional resistance section 91 reliably exists in a position at which the separation claw 77 does not exist so as to perform a separating operation, whereby multiple-sheet feeding can be reduced.

Other Embodiments

The present invention is not limited to the above-described embodiments. It is sufficient that the frictional resistance section have a friction resistance higher than that of the inclined surface of the inclined separation plate. That is, the frictional resistance section may have a surface rougher than that of the inclined surface of the inclined separation plate, or may be made of a material having a higher coefficient of friction than the material of the inclined separation plate. In this case, the inclined separation plate can be easily manufactured without fine-tuning the shape of the inclined separation plate. The frictional resistance section may be integrally formed with the inclined separation plate, or may be formed separately from the inclined separation plate and then attached to the inclined separation plate.

The frictional resistance sections may be disposed only at a lower position with respect to the direction in which the sheets P are stacked, which is upstream with respect to the feed-out direction C, and may not be disposed at a higher position, which is downstream with respect to the feed-out direction C.

In general, when a large number of sheets P are stacked, the sheet feed mechanism, which is rotatable and disposed in the image recording apparatus, pressure contacts the sheets P with a low pressure. This is because the angle between the sheets P and the holder portion, which extends from the drive shaft that is the rotation axis to the feed roller that contacts the sheets P, is small. Thus, the sheet feed mechanism may fail to feed the sheet P. On the contrary, when only a few sheets P are stacked, the sheet feed mechanism pressure contacts the sheets P with a high pressure, because the angle between the sheets P and the holder portion is large. Thus, multiple-sheet feeding, in which a plurality of sheets P are simultaneously fed, may occur.

However, with the above-described structure, the leading edges of the sheets P contact the frictional resistance section only when a few sheets P are stacked and multiple-sheet feeding may possibly occur. That is, multiple-sheet feeding can be reduced because a plurality of frictional resistance sections are disposed on an upstream portion of the inclined separation plate with respect to the feed-out direction C. Moreover, unnecessary separation is not performed when the sheets P are stacked to a large height at which a failure in that any sheet is not fed may possibly occur, because the frictional resistance sections are not disposed at the height.

What is claimed is:

1. A sheet separation device comprising:

a separation member comprising a plurality of first separation portions configured to separate fed sheets one by one by contacting the fed sheets; and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, and each of the plurality of the second separation portions is positioned between a corresponding two of the plurality of the holes, each of the plurality of the first separation portions is positioned to protrude from a corresponding one of the plurality of the holes, and the plurality of the second separation portions protrude from the inclined surface, and for each of the second separation portions, a distance from the inclined surface to a protruding end of one of the plurality of the second separation portions is smaller than a distance from the inclined surface to a protruding end of the adjacent first separation portions of the plurality of the first separation portions.

2. The sheet separation device according to claim 1, wherein the turning member comprises an inclined plate having the inclined surface.

3. The sheet separation device according to claim 1, wherein a coefficient of friction of the plurality of the second separation portions is larger than a coefficient of friction of the inclined surface.

4. The sheet separation device according to claim 1, wherein a surface of the plurality of the second separation portions is rougher than the inclined surface.

5. The sheet separation device according to claim 1, wherein the plurality of the first separation portions have a first contact surface that contacts the sheets, the plurality of the second separation portions have a second contact surface that contacts the sheets, and an angle formed between the inclined surface and the first contact surface is larger than an angle formed between the inclined surface and the second contact surface.

6. The sheet separation device according to claim 1, wherein the plurality of the holes are arranged along the first direction at a predetermined interval.

7. The sheet separation device according to claim 1, wherein the plurality of the first separation portions are made of metal.

8. The sheet separation device according to claim 1, further comprising a plurality of third separation portions positioned to extend from the plurality of the second separation portions in a second direction perpendicular to the first direction.

9. The sheet separation device according to claim 8, wherein the plurality of the third separation portions extend further than the plurality of the second separation portions in the first direction.

10. The sheet separation device according to claim 8, wherein a height of each of the plurality of the third separation portions from the inclined surface is larger than a height of each of the plurality of the second separation portions from the inclined surface.

11. A sheet feed tray comprising:

a sheet separation device comprising:

a separation member comprising a plurality of first separation portions configured to separate fed sheets one by one by contacting the fed sheets; and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, each of the plurality of the second separation portions is positioned between a corresponding two of the plurality of the holes, and each of the plurality of the first separation portions is positioned to protrude from a corresponding one of the plurality of the holes, and the plurality of the second separation portions protrude from the inclined surface, and for each of the second separation portions, a distance from the inclined surface to a protruding end of one of the plurality of the second separation portions is smaller than a distance from the inclined surface to a protruding end of the adjacent first separation portions of the plurality of the first separation portions; and a holding section configured to stack and hold the sheets to be fed.

12. A sheet feed apparatus comprising:

a sheet separation device comprising:

a separation member comprising a plurality of first separation portions configured to separate fed sheets one by one by contacting the fed sheets; and a turning member having an inclined surface and a plurality of holes formed therethrough, the turning member comprising a plurality of second separation portions, wherein the inclined surface is positioned to contact the fed sheets and turn a transport direction of the sheets, the plurality of the holes are arranged along a first direction, wherein the first direction is a transport direction of the sheets, the plurality of the second separation portions are configured to contact the fed sheets, thereby separating the fed sheets one by one, and each of the plurality of the second separation portions is positioned between a corresponding two of the plurality of the holes, each of the plurality of the first separation portions is positioned to protrude from a corresponding one of the plurality of the holes, the plurality of the second separation portions protrude from the inclined surface, and for each of the second separation portions, a distance from the inclined surface to a protruding end of one of the plurality of the second separation portions is smaller than a distance from the inclined surface to a protruding end of the adjacent first separation portions of the plurality of the first separation portions; and a feed roller configured to feed the sheet toward the sheet separation device.

* * * * *